US007547134B2

(12) United States Patent
Hansen

(10) Patent No.: US 7,547,134 B2
(45) Date of Patent: Jun. 16, 2009

(54) ARRANGEMENT FOR MIXING OF FLUID STREAMS

(75) Inventor: Michael Bo Hansen, Bjæverskov (DK)

(73) Assignee: Haldor Topsoe A/S, Lyngby (DK)

( * ) Notice: Subject to any disclaimer, the term of this patent is extended or adjusted under 35 U.S.C. 154(b) by 450 days.

(21) Appl. No.: 11/066,004

(22) Filed: Feb. 25, 2005

(65) Prior Publication Data

US 2005/0190643 A1 Sep. 1, 2005

(30) Foreign Application Priority Data

Feb. 27, 2004 (DK) ..... 2004 00318

(51) Int. Cl.
*B01F 5/00* (2006.01)
*B01F 15/02* (2006.01)

(52) U.S. Cl. ..... 366/175.2; 366/336

(58) Field of Classification Search ..... 366/174.1, 366/175.2, 336; 137/896; 138/37, 39
See application file for complete search history.

(56) References Cited

U.S. PATENT DOCUMENTS

| | | | | | |
|---|---|---|---|---|---|
| 613,093 | A | * | 10/1898 | Tyson | 261/121.1 |
| 889,323 | A | * | 6/1908 | Morgan | 48/189.5 |
| 1,279,739 | A | * | 9/1918 | Merrill | 138/37 |
| 1,937,875 | A | * | 12/1933 | Denman et al. | 48/189.4 |
| 2,361,150 | A | * | 10/1944 | Petroe | 138/37 |
| 2,553,141 | A | * | 5/1951 | Maynard | 138/37 |
| 4,034,965 | A | | 7/1977 | King | |
| 4,085,462 | A | * | 4/1978 | Booy | 366/175.2 |
| 4,498,786 | A | * | 2/1985 | Ruscheweyh | 366/336 |
| 5,547,540 | A | | 8/1996 | Ruscheweyh et al. | |
| RE36,969 | E | * | 11/2000 | Streiff et al. | 366/173.1 |
| 7,059,118 | B2 | * | 6/2006 | Ripper et al. | 60/286 |
| 2005/0189026 | A1 | * | 9/2005 | Hansen | 137/896 |
| 2005/0190643 | A1 | * | 9/2005 | Hansen | 366/181.5 |

FOREIGN PATENT DOCUMENTS

| | | | |
|---|---|---|---|
| DE | 37 23 618 | | 12/1988 |
| DE | 42 11 031 | * | 10/1993 |
| EP | 0 352 902 | | 1/1990 |
| EP | 0 638 732 | | 2/1995 |
| EP | 1 107 821 | | 6/2001 |
| EP | 1 166 861 | | 1/2002 |
| EP | 1 170 054 | | 1/2002 |
| EP | 1 568 410 | * | 8/2005 |
| WO | WO-89/12025 | | 12/1989 |

* cited by examiner

*Primary Examiner*—Tony G Soohoo
(74) *Attorney, Agent, or Firm*—Dickstein Shapiro LLP

(57) ABSTRACT

An arrangement for mixing fluid streams in a duct, said arrangement comprising: at least one mixing device having front side and back side and positioned within said duct through which a first major stream travels, the at least one mixing device determining a total cross-sectional area which is significantly lower than that of the duct so as to allow for the passage of said first major stream, in which the at least one mixing device is a solid plate provided with one or more protrusions extending outward from the main solid plate body.

7 Claims, 3 Drawing Sheets

ARRANGEMENT FOR MIXING OF FLUID STREAMS

FIELD OF THE INVENTION

The present invention relates to an arrangement for the mixing of fluid streams in a duct with at least one mixing device being positioned within said duct and in particular the invention relates to a novel mixing device for such an arrangement.

The invention relates particularly to arrangements of this type, which are constructed so as to be suitable for use in applications including reduction of nitrogen oxides and reduction of sulphuric acid from acid mist in flue gas cleaning.

BACKGROUND OF THE INVENTION

The proper mixing of single fluid streams or several fluid streams that interact in ducts or channels requires the presence of relatively turbulent regions by the generation of velocity components transverse to the main major fluid stream passing through the duct. In order to achieve proper mixing between for instance one or more fluid streams being injected into a major fluid stream, a certain distance along the duct (channel) is required. Conventionally this is quantified in terms of channel diameters as so-called mixing distances. In the present specification mixing distance is regarded as the distance from the point where the first mixing device is placed and the point where the desired mixing of the stream is achieved. By mixing is meant a unification of properties of the streams involved in terms of mass flow, velocity, temperature and concentration of species present. Mixing distances can vary within a range of 1-100 channel diameters depending among other things on the type of fluid stream, relative volume flows and concentration of species within the fluid streams. In the present patent specification a fluid stream can be a gas, a liquid or a stream of particles suspended in a gas, e.g. an aerosol. By aerosol is meant a collection of very small particles dispersed in a gas.

The reduction of mixing distances is highly desirable and can be achieved by the implementation of static mixers, i.e. motion-less mixing devices. These are basically devices that are free of driven parts and where fluid streams are mixed or stirred passing through the static mixer. Local turbulence near the static mixer is created and consequently homogenisation of the one or more fluid streams in contact with the mixer can be achieved.

The use of static mixers has the penalty that their use manifests itself in considerable pressure loss in the duct, with the attendant effect of costly energy losses. Although major pressure losses can be accepted in applications where good mixing is of utmost importance, there is still a need for efficient static mixers or arrangement of static mixers that are capable to impart good mixing of interacting streams with a relatively low penalty in terms of pressure loss.

Good mixing of interacting streams is particularly relevant in applications related to gas cleaning, e.g. flue gases from combustion facilities or high temperature furnaces where gaseous pollutants are generated. Where the pollutant carried by the major gas stream is nitrogen oxide ($NO_x$), a reducing agent such as ammonia is injected as the active species of a second stream. In this process the amount of ammonia incorporated by the second stream is much lower than the volume flow of the main or major stream. Consequently, the use of small amounts of ammonia imposes a great demand on the homogeneity or degree of mixing of the gas mixture. The mixed gas travels forward to a catalysis unit, where the oxides of nitrogen are reduced into free nitrogen by reaction with ammonia.

Because the outlet opening of the second stream being injected into the duct carrying the first major stream may only protrude a short distance inwardly from the wall of the duct, the concentration of the active species of the second stream, e.g. ammonia, towards the centre of the duct may tend to decrease, thus contributing to poor mixing. It is essential that substantially equal concentrations of ammonia prevail throughout the whole cross section of the duct while the major stream travels towards the catalysis unit. Poor mixing or poor homogeneity of the injected ammonia may imply higher $NO_x$ levels in the stack as well as unwanted levels of ammonia passing unreacted through the catalyst unit.

Other applications can be envisaged, for example the reduction of acid-mist formation from the manufacturing of sulphuric acid. During the condensation of sulphuric acid, sulphuric acid mist is generated. This acid mist can be seen as an aerosol consisting of small droplets of sulphuric acid. Environmental demands with regards to the escape of acid mist from sulphuric acid manufacturing plants are very stringent and several methods have been published to regulate acid mist emissions. One of the methods published, for instance as described in EP patent No. 419,539, relies on the presence of small particles in the gas acting as nucleation seeds for the condensation of sulphuric acid in order to stimulate the generation of greater sulphuric acid droplets. These droplets are larger when the condensation takes place in the presence of nucleation seeds, thus making their subsequent filtering much easier and more efficient and thereby bringing the escape of acid mist within environmental acceptable levels. In this process, nucleation seeds having diameter of for instance below 1 μm can be added as a particle suspension (smoke from metal oxides generated by electric-welding, smoke from fuel combustion, e.g. smoke from the combustion of silicone oils) into the feed air prior to condensation of sulphuric acid. Suitable ways of introducing a stream comprising the nucleation seeds are described in EP patent No. 419,539. The success of the process depends on the ability of the nucleation seeds to interact with the sulphuric acid vapours. This interaction is promoted by mixing.

The necessity of adequate mixing devices, in particular static mixers in order to provide for thorough mixing of fluid streams without considerable pressure loss within ducts or channels is well recognised in the art.

U.S. Pat. No. 4,527,903 discloses a system for the mixing of at least two flows discharging into a main flow comprising eddy insert surfaces that can vary in shape. FIGS. 5-10 of this citation show a wide range of shapes for the eddy insert units, for instance circular, parabolic or diamond base. The eddy insert surfaces can be used in cooling towers, where two different streams discharge into a main flow, or in stacks and pipeline systems.

U.S. Pat. No. 6,135,629 discloses an arrangement of mixing devices or insertion structures for the mixing of several fluid streams. The insertion structures are folded along straight lines to form ω or w cross-sections so they are thinner and lighter in weight than in conventional insertion structures. These permit the incorporation of relatively light supports to secure the insertion structures in such a way that the mechanical design of the system is improved. The cited conventional insertion structures or generic devices requiring relatively heavy support structures are denoted as being circular, elliptical, oval, parabolic, rhomboidal or triangular. The objective of the invention is to improve the generic devices by decreasing the weight of the structures and supports.

U.S. Pat. No. 5,456,533 discloses a static mixing element in a flow channel comprising deflectors attached to mounting items at a distance from the channel wall. The deflectors form an angle relative to the main flow direction and can be of different shapes. FIGS. 3*a*-3*d* of this citation show for instance deflectors having substantially circular and triangular shapes.

EP 1,170,054 B1 discloses a mixer for mixing gases and other Newtonian liquids comprising built-in-surfaces positioned within a flow channel so as to influence the flow. The built-in-surfaces are positioned transverse to the main flow direction and partly overlap. This provides the homogenisation of the velocity profile of the flow by means of the built-in-surfaces. It is stated that the built-in-surfaces can be round discs, disks with delta-shaped or triangular basic shapes or elliptical or parabola-shaped disks. The mixer enables fast mixing of the stream in the flow channel within a very short mixing distance.

U.S. Pat. No. 5,547,540 discloses a device for cooling gases and drying solid particles added to gases in which the mouth of the inlet line is in the form of a shock diffuser. Within the area of the shock diffuser one or several inserts are arranged so as to produce a leading edge vortex. FIGS. 3 to 9 in this citation show several shapes, e.g. circular, triangular and elliptical. FIGS. 8 and 9 in this citation depict profiled shapes, for instance a V-shape insert in FIG. 8 to increase the intensity of the mixing and insert with angled edges to stabilise the insert.

EP 638,732 A describes the use of circular built-in surfaces in the expanding area of a diffuser in order to ensure uniform flow at low cost and low pressure losses.

EP 1,166,861 B1 discloses a static mixer in which a flow channel contains a disc that influences the flow and where the disc further comprises a chamber for the passage of a second flow of gas, said chamber being located on the rear side of the disc and further provided with outlet openings. This chamber is integrally connected to a conduit carrying the second stream. This permits rapid mixing of the flow streams in short mixing sections.

Common for all these disclosures is the utilisation of mixing devices that are regular shaped. By mixing devices that are regular shaped is meant mixing devices that have a non-hollow cross-section and present shapes that are substantially circular, trapezoidal, elliptic, diamond-like, tri-angular or the like. That is, free of protrusions extending outward from the periphery or main body of the mixing device.

More sophisticated static mixers are disclosed in U.S. Pat. Nos. 4,929,088 and 5,605,400. These describe relatively expensive hollow mixing devices with protrusions or projections directed inward from the periphery of the devices.

U.S. Pat. No. 4,929,088 describes a simple static mixer to induce mixing of a flow within a conduct in which one or more ramped tabs project inward at an acute angle from the bounding surface, i.e. channel walls, such that the tabs are inclined in the direction of the flow. The static mixer is hollow in order to allow for the passage of flow through it and its periphery corresponds substantially to the periphery of the channel, e.g. a wall pipe. The mixing device can be seen as having protrusions directed inwards from the periphery of the flow channel.

U.S. Pat. No. 5,605,400 describes a cylindrical mixing element for the passage of fluids through it comprising a number of so-called spiral blade bodies arranged inside the mixing element. These bodies are arranged so as to form a number of fluid passages extending spirally along the length of the mixing element. The blade bodies are formed independently to the cylindrical mixing element and are joined to it by means of e.g. welding. It is stated that this results in a static mixer of high mixing efficiency produced at relatively low cost compared to similar mixing elements in which the cylindrical element and blade bodies are unitedly formed.

U.S. Pat. No. 4,034,965 describes a static mixer having a central flat portion and oppositely bent ears. The oppositely bent ears are disposed substantially transversally to the fluid stream in a conduit, whereas the plane of said central flat portion is intended to be aligned with the longitudinal axis of the conduit. The ears are configured at their outside peripheries for a general fit to the conduit wall or preferably to "spring" against the conduit wall.

Even more sophisticated static mixers comprise channels subdivided into smaller corrugated sections that form a number of smaller compartments. This arrangement splits the flow into separate streams so that intensive interaction in between the streams is created. The separate streams are then redirected so as to form a homogenous mixture. This type of static mixer (Sulzer SMV gas mixer) provides a good mixing with a relatively low pressure loss. However, they are rather expensive and may require a greater number of injection points for the introduction of a second stream into the major fluid stream than when utilising regular shaped static mixing devices.

In order to cope with commercially accepted ranges of pressure loss, the simpler mixing devices having a regular shape are conventionally positioned in such a way that the first major stream impacts the front side of the mixing device at a given incidence angle. EP 1,170,054 describes for instance an arrangement of regular shaped bodies, such as round disks disposed substantially transversally to the main flow direction and forming an angle of 40° to 80°, preferably 60° with respect to the main flow direction. The incidence angle is the angle formed between the major fluid stream direction and a plane defined along the cross-section of the mixing device.

It would be understood that a compromise is needed between having a very high incidence angle, for instance 90°, whereby the mixing device is positioned transversely to the main direction the first major stream and a low incidence angle, for instance 0°, whereby the mixing device is aligned with the main direction the first major stream. In the former, the projected area of the mixer on a plane transverse to the main stream direction equals the cross sectional area of the mixing device. This configuration promotes the creation of turbulent flow regions on the back side of the mixing device, but imposes a great pressure loss. In the latter arrangement, where the incidence angle is 0° the mixing device does not exert any influence on the major stream. The projected area of the mixer on a plane transverse to the main stream direction is zero, consequently, no turbulent flow regions are created and poor mixing results. However, the pressure loss is very low. The projected area of the mixing device on a plane transverse to the major stream direction is important. A higher projected area implies a higher generation of turbulent regions on the back side of the mixer and thereby better mixing of the stream (s). Accordingly, it would be desirable to provide an arrangement of mixing devices having an optimal incidence angle with respect to the major fluid stream in order to be able to increase the degree of mixing with a minimum penalty in terms of pressure loss.

A major problem confronted in the art is therefore that it is desirable to obtain a good mixing of interacting fluid streams within a relatively short mixing distance along the duct without compromising the energy efficiency of the system imposed by the high pressure loss exerted by the mixing device.

Alternatively, it is desirable to be able to find means for the achievement of a better mixing of a single fluid stream or at least two meeting fluid streams within a commercially accepted pressure loss range compared to the mixing obtained from prior art mixing devices, particularly mixers having a base regular shape for instance circular or elliptical. Further, it would be desirable to be able to provide a mixing device that can solve the problem of efficient mixing of fluid streams with a minimum loss of pressure, at low expense and by providing simple means.

Another problem encountered with particularly conventional regular shaped mixing devices, for instance circular or elliptical mixers, is that the positioning of these within rectangular or square ducts may result in relative poor mixing at or near the corner regions of the duct.

Accordingly, we have realised that it would be desirable to redesign the known regular shaped mixing devices, particularly substantially circular or elliptical mixers, in order that they become much efficient in terms of providing good mixing with the concomitant effect of reduced mixing distances in the duct. In particular, we have realised that it would be desirable if all this could be achieved with mixing devices that induce a better degree of mixing within a commercially accepted range of pressure loss than with conventional regular shaped mixers.

According to the invention, we provide an arrangement for mixing fluid streams in a duct, said arrangement comprising: at least one mixing device having front side and back side and positioned within said duct through which a first major stream travels, the at least one mixing device determining a total cross-sectional area which is significantly lower than that of the duct so as to allow for the passage of said first major stream, the at least one mixing device being a solid plate disposed substantially transversally to the travelling direction of said first major stream and provided with one or more protrusions extending outward from the main solid plate body.

By solid plate is meant any sheet of metal or other material aligned substantially transversally to the stream flow and which is able to divert or control said flow within a closed space. By main solid plate body is meant the regular shaped, e.g. circular, body that constitutes said solid plate and from which the protrusions emerge.

It has surprisingly been found that the provision of protrusions in the solid plate significantly increases the degree of mixing of fluid streams. It is believed that the protrusions act like arms that are able to grab and impart additional motion to the flow in potentially dead zones around the solid plate, in particular near or at the corners of square or rectangular ducts. Dead zones are understood as zones where the velocity vectors forming part of the velocity profile of the major stream in its travelling direction shortens, i.e. the velocity approaches zero. It would be understood that since the solid plate is aligned substantially transversally to the first major stream, the solid plate acts as the major mixing element, thus creating relatively large eddies on its back side. The protrusions aid the major mixing generated by the impact of the flow on the front side of the solid plate by creating small eddies, which are entrained in the larger eddies on the back side of the solid plate.

Since in many circumstances one or more fluid streams need to be mixed with a first major fluid stream, the invention also provides an arrangement to this purpose. Thus in a preferred embodiment, we provide an arrangement for mixing fluid streams in a duct, said arrangement comprising: at least one mixing device having front side and back side and positioned within said duct through which a first major stream travels, the at least one mixing device determining a total cross-sectional area which is significantly lower than that of the duct so as to allow for the passage of said first major stream; injection means for the introduction of at least one second stream into said duct wherein said first major stream travels, the injection means being adapted so as to provide for the impact of the at least one second stream onto at least a partial region of the back side of the at least one mixing device, the at least one mixing device being a solid plate disposed transversally to the travelling direction of said first major stream and provided with one or more protrusions extending outward from the main solid plate body.

The first major stream may be a flue gas containing nitrogen oxides and said second stream accordingly may be a fluid containing nitrogen oxide reducing agents for example ammonia or urea. Typically the volume flow of said first major stream is much larger than the volume flow of the at least one second fluid stream. The ratio of volume flows of said first major stream with respect to the second stream may be up to 1000:1, for instance 100:1 or 10:1.

The first major stream may also be a flue gas containing condensable sulphuric acid vapour and may contain particles that can act as nucleation seeds for the formation of sulphuric acid droplets.

We find that when compared to regular shaped mixing devices, particularly circular mixers, the inventive mixing devices are less obstructive to the main fluid stream. The inventive mixing devices incorporate a certain degree of voids or empty spaces in between protrusions at their periphery that result in a relatively low resistance to the major fluid stream, hence further reducing pressure losses. It is believed that the benefits of the inventive mixing devices arise not only because of the creation of local turbulent regions on the back side of the solid plate (mixing device), but also because of the reduced obstruction against the major fluid stream as it impacts on the front side of the solid plate.

In the invention, the mixing devices are preferably positioned in a side-by-side relationship across and along the length of the duct. The mixing devices may also be arranged so as to form a tilted alignment with respect to the major fluid stream travelling within the duct. A tilted alignment offers the advantages that a relatively low resistance to the major stream is provided and the penalty imposed by undesired pressure losses is reduced. The mixing devices may be aligned so as to form overlaps or deflecting regions that force the major stream to deviate from its main travelling direction and thereby further promote mixing or homogenisation of the flow. Such an arrangement utilising circular static mixers is disclosed in EP Patent No. 1,170,054.

In a specific-embodiment of the invention the total cross-sectional area covered by the inventive mixing devices corresponds to the cross-sectional area had the mixing devices been regular shaped, e.g. circular. In this manner, the total cross-sectional area offering the free passage of the mixed stream in the duct remains substantially constant.

The protrusions may have any shape, however, it is preferred that they have a tapering shape pointing outward from the main solid plate body. The number of protrusions can vary; there may be only one protrusion, but better results in terms of mixing are obtained with two to six protrusions, preferably four or five, most preferably five. The cross-sectional area of each individual protrusion can vary, but it is preferred that at least two protrusions exhibit substantially the same cross-sectional area. The term protrusion is to be understood as a region of the solid plate sticking out from the main solid plate, e.g. its periphery, the main solid plate having a regular shape that is circular, elliptical, triangular, deltoid, rhomboid and the like. The protrusions extend preferably outward in the same plane defined by the cross-section of the main solid plate body, but they may also extend outward so as to form an angle with respect with said plane. The protrusions may tilt toward the front side of the solid plate, i.e. pointing towards the major fluid stream or they may tilt toward the back side of the solid plate.

In another advantageous embodiment of the invention, one protrusion extends only slightly away from the main body and corresponds to a region located near and substantially below the outlet of the at least one second fluid stream. Hence, the injection means, for example a conduit for the introduction of ammonia into the major stream, is adapted so as to provide for the impact or contact of the at least one second stream onto at least a partial region of the back side of the solid plate. In this manner back-flow of the second stream is prevented: it is prevented that the second stream travels downward below the solid plate (mixing device) and into its front section. Instead, the second stream is directed upward into the turbulent flow being created downstream, i.e. on the back side of the solid plate.

As a result of the invention the degree of mixing or mixing efficiency is improved within a given mixing distance or within a given (commercially acceptable) pressure loss range. This improvement in mixing with respect to for example circular mixing devices can be quantified (see later in connection with example given in FIG. 3). The benefits of the invention can also be seen in terms of pressure loss: it is now possible to operate with lower pressure loss than is normally possible when operating with conventional circular mixing devices. Alternatively, the mixing distance in a duct needed to obtain the same degree of mixing compared with the use of circular mixers is reduced. The mixing distance in the duct can be reduced (in dimensionless terms) significantly with respect to utilising a conventional circular mixer. For instance, for an arrangement comprising a single mixing device within a square duct, the mixing distance necessary to achieve a given degree of mixing can be reduced from three hydraulic diameters, when utilising a circular mixing device to two hydraulic diameters, when utilising the inventive mixing device.

As a result of the invention it is now possible by simple means to further reduce acid mist formation during the manufacturing of sulphuric acid in flue gas cleaning operations. A typical process comprises pre-heating of the flue gas in a gas-gas heat exchanger followed by the catalytic oxidation of $SO_2$ in the flue gas to $SO_3$ in a catalytic converter. The gas from the catalytic converter is then passed through said gas-gas heat exchanger, whereby its temperature is reduced to about 200-300° C. The gas from the catalytic converter is then further exposed to a subsequent cooling to about 100° C. in a so-called $H_2SO_4$ condenser, whereby $SO_3$ reacts with water vapour to produce $H_2SO_4$-vapour that condenses as concentrated $H_2SO_4$.

The one or more inventive mixing devices can advantageously be positioned at any point upstream said sulphuric acid condensing step, for instance in the duct carrying the feed gas entering said $SO_2$-to-$SO_3$ catalytic converter, or the subsequent duct between the catalytic converter and said gas-gas heat exchanger. Preferably, the one or more mixing devices are positioned in the duct between said gas-gas heat exchanger and the $H_2SO_4$ condenser.

Nucleation seeds having diameter of for instance below 1 μm can be added as a particle suspension generated from smoke from electric-welding, smoke from fuel combustion e.g. smoke from the combustion of mineral or silicone oils. Smoke from the combustion of silicone oils is particularly advantageous because of the significant amount of nucleation seeds that can be generated compared to for example vegetable oils. The nucleation seeds can be added into the feed air prior to condensation of sulphuric acid. Suitable ways of introducing a stream comprising the nucleation seeds are described in EP patent No. 419,539.

The nucleation seeds in the form of a particle suspension can be added as a second stream in the same duct where the at least one mixing device is positioned. The nucleation seeds in the form of a particle suspension can also be added into another duct upstream the at least one mixing device. For example the nucleation seeds can be added into the duct through which the feed gas entering the $SO_2$-to-$SO_3$ catalytic converter travels. Preferably the nucleation seeds are added into the duct upstream the gas-gas heat exchanger, while the at least one mixing device is positioned in the duct between said gas-gas heat exchanger and the $H_2SO_4$ condenser.

DETAILED DESCRIPTION OF THE INVENTION

The invention is illustrated in the accompanying drawings, wherein FIG. 1 shows a schematic vertical cross-sectional view of a flue gas section according to the invention.

Figure 1:
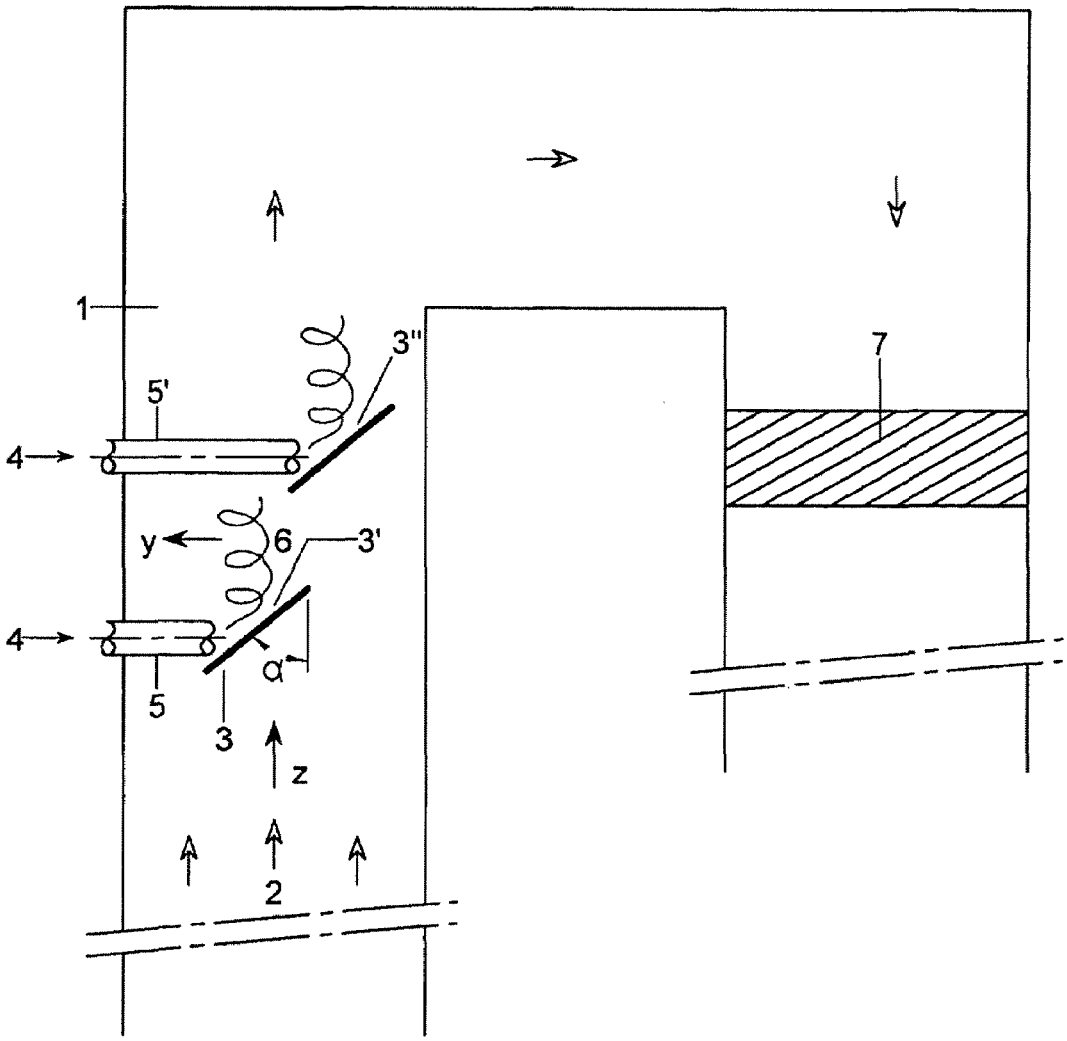

In FIG. 1 the flue gas section for reduction of nitrogen oxides comprises a duct 1 having rectangular section through which a flue gas 2 passes. The flue gas represents a first major fluid stream travelling in direction Z and collides with the front side of mixing device 3, which is disposed substantially transversally to the travelling direction of said first major fluid stream. Mixer 3 is positioned at incidence angle $\alpha$ with respect to the travelling direction of the major fluid stream 2. A second fluid stream 4 is injected through conduit 5 on the backside 3' of solid plate or mixing device 3. The mixing devices 3 creates eddies or turbulent flow 6 as the major stream 3 passes, thereby carrying the second stream 4 and allowing for the mixing of the fluid streams 2, 4. It is realised that good mixing arises because the turbulent flow 6 created on the back side 3' of the mixing device 3 comprises vortex-like sections in which the stream partly flows in direction Y, i.e. transversally to the main stream direction Z. In larger ducts, additional mixing devices. 3" can be arranged to provide for good mixing throughout the whole cross-section of the channel. Additional conduits 5' for the injection of secondary stream 4 can be arranged. Further downstream a catalyst unit 7 can be provided.

Figure 2:
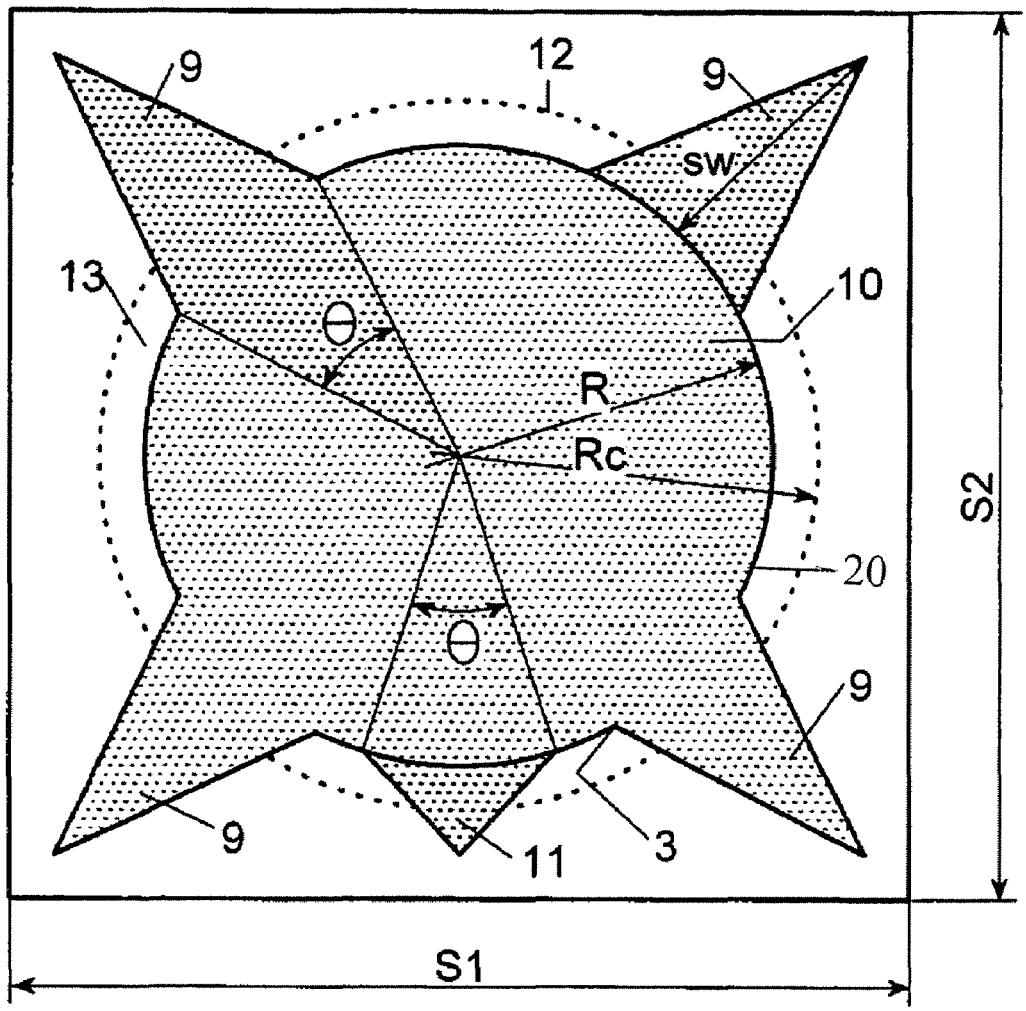
FIG. 2 shows a cross-sectional view of a mixer according to the invention positioned within a square duct.

Referring now to FIG. 2, the front side of a single mixing device 3 is shown. The mixing device is a solid plate comprising triangular protrusions 9 that extend outward from a circumferential arcuate edge 20 of the circular main solid plate body 10. The protrusions extend outward in the same plane defined by the cross-section of the main solid plate body. The mixing device 3 is placed within duct 8 having side lengths S1 and S2. The duct can have any shape, but is preferably square (S1=S2) or rectangular (S1≠S2). The incidence angle .alpha. of the first major fluid stream 2 corresponds in this figure to 90°. The second gas stream impacts on the back side 3'of mixing device 3 and a minor protrusion 11 acts like a tail that impedes back-flow of said second stream 4 into the front section of the mixer 3.

The dotted line 12 around the main solid plate body represents a cross-sectional view having radius Rc of an equivalent mixing device 13 having a circular base shape and where its cross-sectional area corresponds to that of the mixing device 3. For comparison purposes it is intended but not necessarily required that the cross-sectional area of the mixing device 3 equals to that of the corresponding mixing device 13 having a regular base shape, here circular. The base regular shape can also be other than circular, for instance as disclosed in FIGS. 4 to 8 in U.S. Pat. No. 4,527,903.

The shape of the protrusions is preferably such that they taper outward from the main solid plate body 10 having a circular base shape with radius R as in FIG. 2. Hence the protrusions may have a triangular shape, yet other shapes can also be envisaged, for instance rectangular, elliptic or in the shape of a deltoid. The number and shape of the protrusions may vary within a single mixing device so that some protrusions may extend further outward than others. The protrusions can be shortened or expanded at wish, but it can be desirable that the material added or removed is added or removed within the main body 10 by increasing or decreasing its radius R, so that the total cross-sectional area remains substantially constant.

In the mixing device of FIG. 2 four major triangular protrusions 9 are shown as well as minor protrusion 11. It is also possible to have a mixing device 3 having only one major protrusion 9, but the number of major protrusions 9 can also be higher than four or five, for instance six to ten and even more. Preferably, the number of major protrusions 9 is kept at about four in order to improve mixing of the fluid stream(s) in the corners of square or rectangular ducts.

In an advantageous embodiment of the invention, the major protrusions 9 are placed in the corner of a hypothetical rectangle having side lengths S1 and S2 that encompass the mixing device 3. Each protrusion 9 and 11 spans an area corresponding to angle θ. Angle θ can vary from 20° to 45°, but is preferably in the range 25° to 35°, normally 20° to 45°, more preferably between 30° and 40°, most preferably around 30°. It is preferred that the extension SW of the protrusions 9 in the embodiment shown in FIG. 2 is such that $Sw>2\cdot(Rc-R)$. The total cross-sectional area of the mixing device is 50% to 75% or 80% of a hypothetical rectangle or square having side lengths S1 and S2 that encompass the mixing device 3.

The solid plate can be made of materials like metal, glass fibres, plastic or the like. When we refer to solid plate, we encompass various forms of rigid and non-rigid plates, which may or may not be bend by the influence of the major fluid stream. Preferably, the solid plates are relatively thin plates, e.g. 5-20 mm thick, made of metal and do not bend during the passage of the fluid stream.

The minor protrusion 11 can be omitted since its major objective is to prevent back-flow of the second stream into the front section of the solid plate as explained above. It would be realised that the positioning of the mixing device 3 with respect to the outlet of the injection means 5 can be arranged in such manner that back-flow of the second stream 4 is minimised, for instance by letting the second stream 4 impact the back side 3' of the mixing device 3 near its centre region. Accordingly, the outlet of the second stream, which basically corresponds to injection means 5 is adapted so as to provide for the impact of the second stream 4 onto at least a partial region of the back side 3' of the at least one mixing device 3. This impact region spans substantially over the area given by angle θ in the region of the solid plate where minor protrusion 11 is located.

Figure 3:
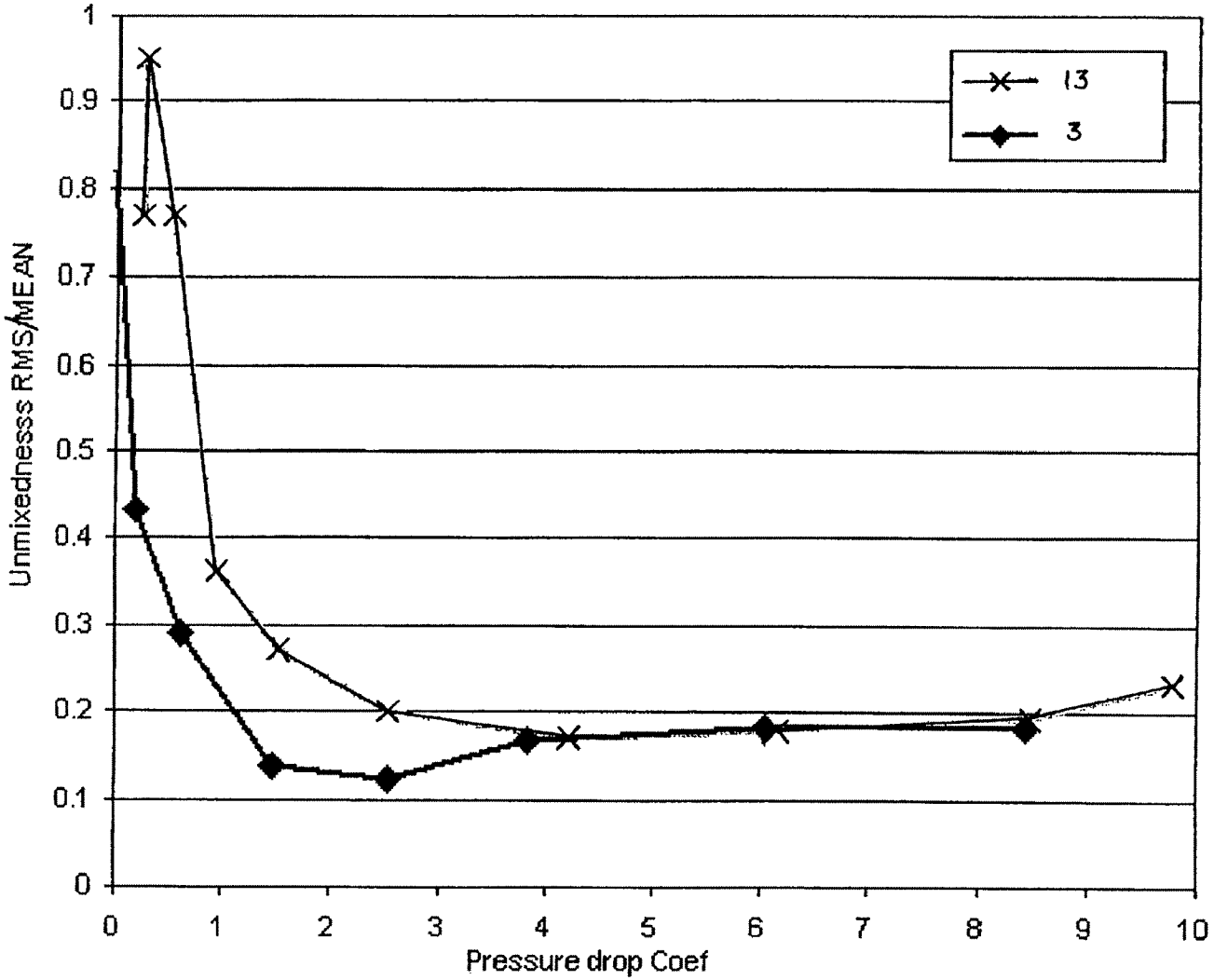
FIG. 3 shows a graph describing degree of mixing as a function of pressure loss for a mixing device according to the invention with respect to a conventional circular mixing device.

FIG. 3 shows a comparative example between a conventional circular mixing device 13 and a mixing device 3 according to the present invention (circular mixer with triangular protrusions of FIG. 2). Both mixers have the same cross-sectional area. Degree of mixing is presented as a function of pressure loss as measured in a square duct having dimensions 200×200 mm. For such a duct a typical value for R is in the range 50-100 mm, for example 77 mm. The comparison is given at a mixing distance corresponding to three hydraulic diameters, wherein hydraulic diameter is defined as the ratio of four times the fluid flow cross section S1·S2 and the wetted circumference 2·(S1+S2). It has to be noticed that degree of mixing in FIG. 3 is actually represented as a so-called Unmixedness; that is, the lower the value of Unmixedness along the Y-axis the better the mixing of the tracer gas in the major gas stream.

Unmixedness in FIG. 3 has been determined according to a laser sheet visualisation method following S. Matlok, P. S. Larsen, E. Gjernes and J. Folm-Hansen "Mixing studies in a 1:60 scale model of a corner-fired boiler with OFA" in 8$^{th}$ International Symposium on Flow Visualisation, 1998, pages 1-1 to 1-6 and accompanying figures. This laser method serves merely to quantify the concentration of a certain species, e.g. tracer gas seeded with a fog (oil smoke) at any mixing distance in the duct, i.e. distance from the point where the first mixing device is placed. However, it would be apparent for the skilled person that other conventional methods are also suitable. For instance, by injecting a tracer gas such as methane and measuring its concentration at a given mixing distance using a suitable tracer gas analyser.

Unmixedness in FIG. 3 is defined by taking the ratio of the standard deviation (RMS) and the mean value (Mean) of the concentration of a species, e.g. a tracer gas seeded with a fog (oil smoke) along the width of a duct at a given mixing distance, here three hydraulic diameters. Therefore, the lower the ratio (RMS/Mean) the lower the deviation from a mean value of concentration along the width of the duct and consequently the better the mixing. The volume flow ratio of the minor stream carrying the tracer gas with respect to the major stream travelling along the duct is approximately 1:100.

Pressure loss along the X-axis in FIG. 3 is given as it is conventional in the art in terms of the number of velocity heads, i.e. as a pressure drop coefficient ϵ, following the relationship:

$$\Delta P=\epsilon\cdot(\tfrac{1}{2}\rho\cdot v^2)$$

where

ΔP is the pressure loss (Pa) and $\frac{1}{2}\rho\cdot v^2$ represents a velocity head (Pa) at a given mixing distance in the duct;

ρ represents the density of the stream (kg/m$^3$), and v its velocity (m/s).

The pressure drop coefficient can be correlated to the incidence angle α of the flow in the duct toward the front section of the mixing device, thus a pressure drop coefficient of between 8 and 9 in the curve corresponds to an incidence angle of about 90°, whereas a pressure drop coefficient of 0 corresponds to an incidence angle of 0°.

In the invention, advantageous results in terms of mixing or pressure loss with respect to circular mixing devices are obtained when the incidence angle is in the range 10° to 80°, particularly between 20° and 60°. Preferably, the incidence angle is between 30° and 50°, most preferably 35° to 45°.

FIG. 3 shows that in the commercially relevant range of pressure drop coefficient, i.e. between 0.5 to 3, the mixing device according to the invention, i.e. with triangular protrusions, has a significantly lower pressure drop coefficient for the same value of RMS/Mean (Unmixedness) when compared to a circular mixing device having the same cross-sectional area. Alternatively, a much better mixing is achieved with the inventive mixing device compared with the circular mixing device at a given pressure drop coefficient. As a particular example, at a commercially relevant pressure drop coefficient of 2, the value of RMS/Mean (Unmixedness) for a conventional circular mixer is about 0.24, whereas for the inventive mixing device of FIG. 2 it is 0.12. As another particular example, for a pre-defined acceptable value of RMS/Mean of 0.2 the circular mixing device of FIG. 2 results in a pressure drop coefficient of about 3, whereas the inventive mixing device of FIG. 2 results in a pressure drop coefficient of about 1. This has to be seen in the context that the range 1 to 3 in pressure drop coefficient along the X-axis corresponds to about 2 mbar. For a conventional power plant station having a major volume flow of 700,000 $Nm^3/h$ a pressure loss of 1 mbar implies a penalty cost of roughly 150,000 EUR over the depreciation time of the plant.

The invention claimed is:

1. An arrangement for mixing fluid streams in a duct (1), said arrangement comprising:

at least one mixing device (3) having front side and back side (3') and positioned within said duct (1) through which a first major stream (2) travels, the at least one mixing device (3) determining a total cross-sectional area which is significantly lower than that of the duct (1)

in which the at least one mixing device (3) is positioned within the duct (1) so that the first major stream (2) forms with the front side of the at least one mixing device (3) an incidence angle ($\alpha$) of between 10° and 80°, wherein the at least one mixing device (3) is in the form of a solid plate comprising a main solid plate body (10) having a circular or elliptical configuration defining a circumferential arcuate edge (20) and one or more protrusions (9, 11) extending outward from the arcuate edge, the one or more protrusions (9, 11) having a triangular configuration and being located in the same plane defined by the cross section of the main solid plate body.

2. An arrangement according to claim 1, further comprising injection means (5) for the introduction of at least one second stream (4) into said duct (1) wherein said first major stream (2) travels, the means of injection (5) being adapted so as to provide for the impact of the at least one second stream (4) onto at least a partial region of the back side (3') of the at least one mixing device (3).

3. An arrangement according to claim 1, wherein said duct (1) is square or rectangular.

4. An arrangement according to claim 1, wherein the one or more protrusions (9, 11) taper off outward from the main solid plate body (10).

5. An arrangement according to claim 1, wherein the at least one mixing device (3) are positioned in a side-by-side relationship across and along the length of the duct (1), wherein the mixing of the fluid stream (2,4) takes place.

6. An arrangement according to claim 1, wherein the incidence angle ($\alpha$) is 30° to 50°.

7. An arrangement according to claim 1, wherein the at least one mixing device (3) comprises at least one or more major protrusions (9), but no minor protrusions (11).

* * * * *